United States Patent [19]

Sage et al.

[11] Patent Number: 4,833,901

[45] Date of Patent: May 30, 1989

[54] WRAP & LOCK SKI HOLDING ASSEMBLY

[76] Inventors: Jeffrey D. Sage; Jerry D. Sage, both of 365 S. Main, Richmond, Id. 83349

[21] Appl. No.: 217,306

[22] Filed: Jul. 11, 1988

[51] Int. Cl.[4] ..... E05B 73/00

[52] U.S. Cl. ..... 70/58; 70/14; 280/814; 224/917

[58] Field of Search ..... 70/57–59, 70/30, 49, 229, 230, 232–234, 14; 211/60.1, 70.2, 70.5; 280/814, 819; 224/202, 257, 917

[56] References Cited

U.S. PATENT DOCUMENTS

| | | | |
|---|---|---|---|
| 3,272,526 | 9/1966 | Rumaner | 280/814 |
| 3,815,391 | 6/1974 | Latta | 70/209 |
| 3,838,585 | 10/1974 | Foote | 70/58 X |
| 3,947,927 | 4/1976 | Rosenthal | 280/814 X |
| 3,959,995 | 6/1976 | Fletcher | 70/58 X |
| 3,985,275 | 10/1976 | Allen | 70/58 X |
| 3,990,655 | 11/1976 | Covell | 70/58 X |
| 3,994,048 | 11/1976 | Rosenthal | 280/814 X |
| 4,015,762 | 4/1977 | Mendillo | 280/814 X |
| 4,057,982 | 11/1977 | Drayton | 70/14 |
| 4,057,983 | 11/1977 | Morgan | 70/58 X |
| 4,114,838 | 9/1978 | Knauf | 280/814 X |
| 4,120,437 | 10/1978 | Hara | 280/814 |
| 4,185,361 | 1/1980 | Stuart | 70/58 |
| 4,326,747 | 4/1982 | Finnegan | 70/58 X |
| 4,377,306 | 3/1983 | Abatecola | 280/814 X |
| 4,674,787 | 6/1987 | DeVera | 280/814 X |
| 4,683,730 | 8/1987 | Lee | 70/59 |
| 4,729,591 | 3/1988 | Scalise | 280/814 X |

*Primary Examiner*—Robert L. Wolfe
*Assistant Examiner*—Suzanne L. Dino
*Attorney, Agent, or Firm*—Frank J. Dykas; Craig M. Korfanta

[57] ABSTRACT

A flexible ski locking apparatus 10 for locking a pair of skis 1 and ski poles 2 to a stationary object 3 is constructed from outer wrapping strap 11 joined to inner wrapping strap 12. Both outer and inner wrapping straps 11 and 12 have a fastening means 14 attached to each end for joining the ends of each strap together. Locking strap 13 is integrally attached to outer wrapping strap 11 and provides a mechanism for locking the outer wrapping strap around a pair of skis 1 and ski poles 2 in a wrapped position and further securing the outer wrapping strap to a stationary object 13. Pocket 15 is attached to outer wrapping strap 11 and provided to harbor locking strap 13 when in an unused state. A separate sealing means is provided on the upper edge of pocket 15 to seal the locking strap within pocket 15.

4 Claims, 6 Drawing Sheets

WRAP & LOCK SKI HOLDING ASSEMBLY

BACKGROUND OF THE INVENTION

1. Technical Field. This invention generally relates to an apparatus for holding ski equipment together and locking it to a stationary object. In particular, this invention relates to a portable light weight apparatus for locking a pair of skis and a pair of ski poles to a stationary object, such as a ski rack.

2. Background Art. Snow skis and ski poles are favorite targets of thieves. Generally, ski thefts occur in the immediate vicinity surrounding a ski lodge. From time to time during the course of a day of skiing, skiers stop in the ski lodge to eat, rest, and get warm. During the time in the lodge, the skier must leave his equipment unattended, outside the ski lodge. At any given time, outside of a typical ski lodge, there might be several hundred pairs of skis and ski poles. Consequently, it is very easy for a thief to walk away with a pair of skis and ski poles without arousing suspicion.

Several devices have been provided for securing skis and poles outside of the ski lodge which include coin operated stationary lockable racks. Unfortunately the coin and locking mechanisms are unreliable at low temperatures and very frequently are inoperable. Additionally, the availability of locking ski racks is very limited as the racks are expensive to purchase and maintain.

One solution to the shortcomings of the stationary rack is offered by the apparatus taught by BONNETT, U.S. Pat. No. 3,935,977, which teaches a ski equipment securing and carrying device generally formed of a one piece molded polypropylene. The device of Bonnett may be locked to a stationary object by looping a chain or bicycle type lock through the handle and around a stationary object. The problem with the device of Bonnett is that it is too bulky to be carried by a skier while skiing and therefore must be stored either in the lodge or in a vehicle. This creates a great inconvenience and in fact even defeats the purpose of having a locking device, as the skier must leave the skis unattended while retrieving the device from inside of the lodge or vehicle.

Of particular interest to the present problem is a carrying and locking strap taught by NEWMAN, U.S. Pat. No. 4,261,493, which teaches an elongated strap having a nonremovable ring at one end and a combination lock secured to the other which may be wrapped around a pair of skis and ski poles and further around a stationary object and locked in place. The device, as taught by Newman, would seem to be a perfectly acceptable solution, however, because of the predetermined length of the elongated strap and the fact that it is nonadjustable in length, the locking feature of the device is easily circumvented. In practice, any two stationary fixtures to which the skis could be locked are of different circumferential size. Consequently, the strap cannot usually be wrapped tightly enough around the skis, poles, and stationary fixture to prevent the skis or poles from easily being slipped out from the confines of the elongated strap.

What is needed is a device which is flexible and compact, and which securely encloses a pair of skis and ski poles separate from the stationary fixture and can still be lockably attached to a stationary fixture.

Accordingly, it is an object of this invention to provide a lightweight, compact, and portable locking apparatus for skis and ski poles which is not easily circumvented by a would be thief.

DISCLOSURE OF INVENTION

This object is accomplished by a flexible wrapping strap, which may be composed of nylon fabric, having an outer wrapping strap and an inner wrapping strap. The outer wrapping strap, or binding strap, is of sufficient length to enclose a pair of skis and a pair of ski poles. The inner wrapping or inner binding strap is of sufficient length to enclose a pair of skis and is further attached to the outer wrapping strap. A locking strap provides a means for locking the outer wrapping strap around a pair of skis and ski poles and further to a stationary fixture. The locking strap, normally a chain, is integrally attached around the length of the outer wrapping strap. Both the outer and inner wrapping straps have a fastening means, such as hook and loop fastening material, attached to each end for attaching one end of each strap to the other end of the same strap. A pocket is attached to the outside face of the outer binding strap and is used for harboring the locking strap when the strap is not in use. A sealing means is provided to seal the pocket closed while harboring the locking strap.

BEST MODE FOR CARRYING OUT INVENTION

Figure 1:
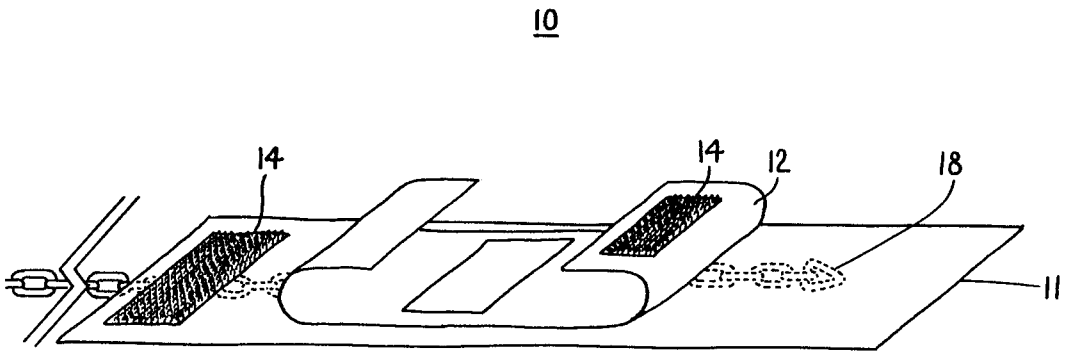
FIG. 1 is a perspective view of the inside face of a flexible ski locking apparatus.

In its preferred embodiment, flexible ski locking apparatus 10, is shown resting with the inside face up in FIG. 1. Ski locking apparatus 10 generally provides a means for wrapping a pair of skis and ski poles, which in this embodiment is constructed from outer wrapping strap or binding strap 11 and inner wrapping strap or inner ski strap 12. Outer wrapping 11 and inner wrapping 12 are advantageously constructed of nylon fabric and sewn together about their geometric centers. A fastening means 14, such as hook and loop fastening material, is provided at both ends of both the outer wrapping strap 11 and inner wrapping !2. Fastening means 14 allows the individual straps to be wrapped around an object and secured in a fastened position by joining the ends of a particular strap together, one to another.

Figure 2:
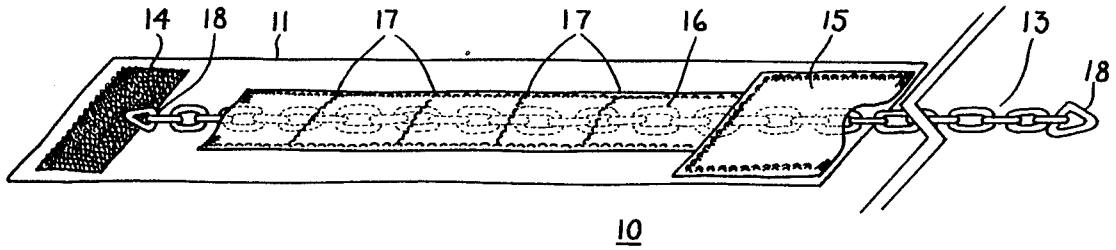
FIG. 2 is a perspective view of the outside face of the ski locking apparatus.

Referring now to FIG. 2, flexible ski locking apparatus 10 is shown resting with its inner or bottom side down. A means for locking wrapping strap 11 in a wrapped position and to a stationary object, such as a ski rack, tree or the like, is provided and is shown in this particular embodiment as locking chain 13. Locking chain 13 is integrally attached to outer wrapping 11 by locking strap cover 16 which is integrally stitched to outer wrapping strap 11 by means of integral stitching 17. Locking chain 13 is of sufficient length to fully enclose a pair skis and ski poles and a stationary object and further to separately secure outer wrapping strap 11 in a wrapped position around a pair of skis and ski poles. Lock ring 18, which in this preferred embodiment consist of a D ring, is secured to the end of locking chain 13 which is integrally connected to outer wrapping strap 11. A pocket 15 is attached to one end of outer wrapping strap 11 and is used to harbor the unattached segment of locking chain 13 when it is not being used. A suitable sealing means (not shown) is provided for the open edge of pocket fifteen for sealing the pocket in a closed position when the chain is not in use.

Figure 3:
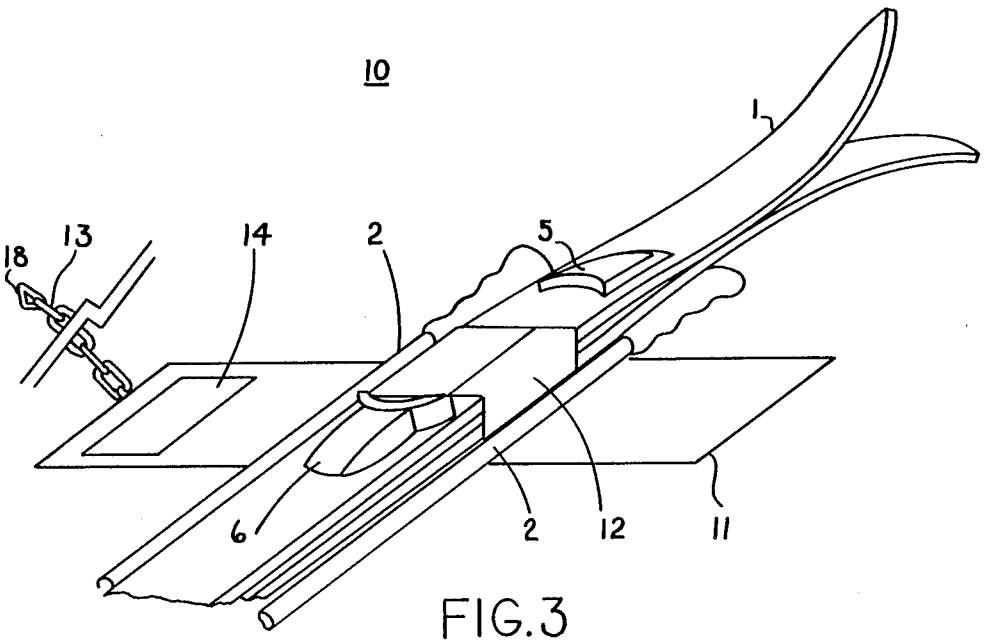
FIG. 3 is a perspective view of a pair of skis and ski poles being enclosed by the flexible ski locking apparatus.

Referring now to FIG. 3, a typical configuration is shown and has a pair of snow skis 1 held in a wrapped position by inner wrapping strap 12 and a pair of ski poles 2 lying beside the pair of skis 1 on the inside of outer wrapping strap 11. Flexible ski locking apparatus 10 is advantageously shown attached to the pair of skis 1 between ski binding toe piece 5 and ski binding heel piece 6.

Figure 4:
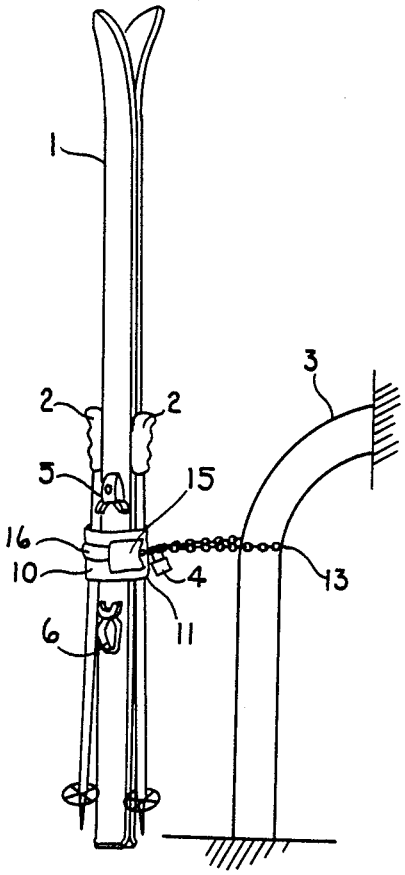
FIG. 4 is a perspective, representational, view of a pair of skis and ski poles locked to a stationary fixture using the flexible ski locking apparatus.

Referring now to FIG. 4, skis 1 and ski poles 2 are shown locked to stationary fixture 3. Of particular interest is the attachment of padlock 4 to locking chain 13. The configuration as shown, allows the outer wrapping 11 to be locked into a wrapped position around skis 1 and ski poles 2 independent and separately of the stationary fixture 3. This is an important feature of my present invention in that the security of my device is independent of the circumference of the stationary object.

Figure 5:
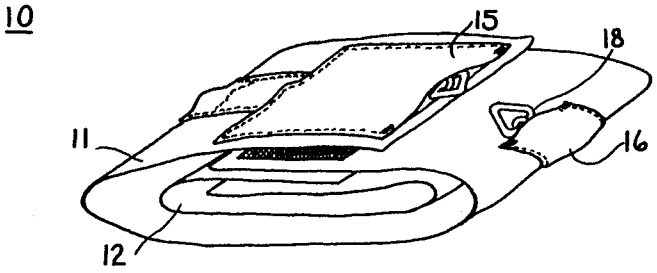
FIG. 5 is a perspective view of the flexible ski locking apparatus in a compact collapsed state.
Figure 6:
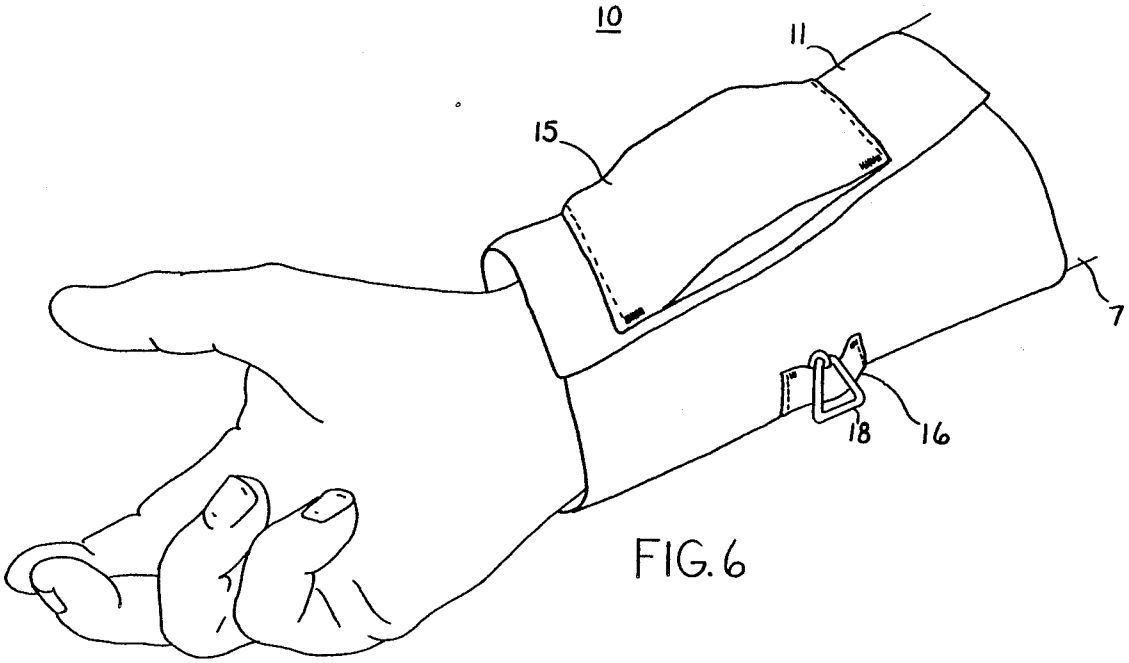
FIG. 6 is a perspective view of one method of carrying the flexible ski locking apparatus while not in use.

Referring now to FIG. 5, flexible ski locking apparatus 10 is shown in a collapsed and compact state which facilitates easy storage within a ski parka pocket of the skier. Further, the locking ring 18 can easily be clipped to an exterior zipper or glove clip. FIG. 6 shows an alternative method of carrying the flexible ski locking apparatus 10 which consists of wrapping the flexible ski locking apparatus around a limb, such as the skier's wrist 7.

While there is shown and described the present preferred embodiment of the invention, it is to be distinctly understood that this invention is not limited thereto but may be variously embodied to practice within the scope of the following claims.

We claim:

1. A portable ski and pole lock for use with a padlock, for securing a pair of skis and a pair of ski poles to a stationary object, which comprises:

a flexible fabric inner ski strap, having fastening means at each end for fastening one end to the other, said strap being of sufficient length to surround a pair of skis;

a flexible fabric binding strap attached, at its center, to the center of said inner ski strap, said binding strap further having fastening means for each end for fastening one end to the other, said binding strap being of sufficient length to surround a pair of ski poles and a pair of skis;

a length of chain integrally connected to said binding strap along the length of said binding strap, said chain being of sufficient length to surround a pair of skis, a pair of poles, and a stationary object;

a pocket attached to said binding strap and having fastening means for sealing the pocket when closed, said pocket being used for harboring said chain when it is not being used.

2. The portable ski and pole lock of claim 1 wherein said length of chain is integrally connected by a locking strap cover being integrally stitched to said binding strap and through said length of chain.

3. The portable ski and pole lock of claim 2 wherein said flexible fabric inner ski strap, said flexible fabric binding strap and said locking strap cover are constructed of nylon fabric.

4. The portable ski and pole lock of claim 1 wherein said flexible fabric inner ski strap and said flexible fabric binding strap are both constructed of nylon fabric.

* * * * *